US005810950A

United States Patent [19]

Kim et al.

[11] Patent Number: 5,810,950

[45] Date of Patent: Sep. 22, 1998

[54] METHODS FOR ANNEALING AND PICKLING HIGH MANGANIC COLD ROLLED STEEL SHEET

[75] Inventors: Tai Woung Kim; Shin Hwa Park, both of Pohang; Young Gil Kim, Seoul, all of Rep. of Korea

[73] Assignees: Pohang Iron & Steel Co., Ltd.; Research Institute of Industrial Science & Technology, both of Pohang, Rep. of Korea

[21] Appl. No.: 894,829

[22] PCT Filed: Dec. 18, 1996

[86] PCT No.: PCT/KR96/00242

§ 371 Date: Aug. 28, 1997

§ 102(e) Date: Aug. 28, 1997

[87] PCT Pub. No.: WO97/24467

PCT Pub. Date: Jul. 10, 1997

[30] Foreign Application Priority Data

Dec. 30, 1995 [KR] Rep. of Korea ..... 1995-68457

[51] Int. Cl.[6] ..... C21D 7/13

[52] U.S. Cl. ..... 148/620; 148/619

[58] Field of Search ..... 148/619, 620; 420/72, 73, 74, 75

[56] References Cited

U.S. PATENT DOCUMENTS 4,047,979 9/1977 Grange et al. .
5,431,753 7/1995 Kim et al. ..... 148/620
5,634,990 6/1997 Choi et al. ..... 148/620
5,647,922 7/1997 Kim et al. ..... 148/620

FOREIGN PATENT DOCUMENTS 1994-7374 8/1994 Rep. of Korea .
1994-8945 9/1994 Rep. of Korea .

*Primary Examiner*—John Sheehan
*Attorney, Agent, or Firm*—Webb Ziesenheim Bruening Logsdon Orkin & Hanson, P.C.

[57] ABSTRACT

Methods for annealing and pickling high manganese cold rolled steel sheets for use in automobiles and electronic panels in which a superior formability and high strengths are required are disclosed. That is, the invention provides a method for annealing a cold rolled high manganese steel sheet, in which, after cold-rolling a high manganese steel of Fe—Mn—Al—C series, the annealing atmospheric gas is adjusted during an annealing so as to minimize the thickness of a surface oxide layer, and an oxide layer removing agent such as aluminum nitride is spread into the oxide layer, so that the surface oxide layer can be easily removed. The invention further provides a method for pickling a cold rolled high manganese steel sheet, in which the surface oxide layer formed on the cold rolled high manganese steel sheet is uniformly removed with a mild aqueous solution of chloric acid, thereby improving the surface quality of the steel sheet, and saving the pickling facility cost. When the high manganese steel sheet is annealing at a temperature of 500°–1000° C., the annealing atmosphere consists of 100% of nitrogen or 50% or more of nitrogen and a balance of hydrogen. The high manganese steel sheet is pickled for 30–90 seconds within an aqueous solution of chloric acid having an acid concentration of 0.06–0.8 weight % and a temperature of 15°–50° C.

6 Claims, 1 Drawing Sheet

○ : Transparent blue oxid layer is produced.

● : Black oxid layer is produced.

△ : No oxid layer is produced.

○ : Transparent blue oxid layer is produced.

● : Black oxid layer is produced.

△ : No oxid layer is produced.

METHODS FOR ANNEALING AND PICKLING HIGH MANGANIC COLD ROLLED STEEL SHEET

FIELD OF THE INVENTION

The present invention relates to methods for annealing and pickling a high manganese cold rolled steel sheet for use in manufacturing automobiles and electronic panels in which a superior formability and high strengths are required. In particular, the present invention relates to a method for annealing high manganese cold rolled steel sheets, in which the surface oxidation is inhibited to the minimum during a continuous annealing after a cold rolling. And also, the present invention relates to a method for pickling a high manganese cold rolled steel sheet, in which the surface oxide layer can be easily removed.

DESCRIPTION OF THE PRIOR ART

Recently, in the automobile industry, the discharge of carbon dioxide came to be regulated for preventing the aggravation of the air pollution. In this connection, in the field of the automobile steel sheets, high formability and high strength steel sheets are in demand. The automobile weight can be reduced and the combustion efficiency can be improved.

Conventionally, in view of its formability, the extremely low carbon steel, in which the matrix is ferrite, is used for the automobile steel sheets. However, in the case where an extremely low carbon steel is used as the automobile steel sheet, the formability is superior, but the tensile strength is low, down to 28–38 $Kg/mm^2$. Therefore, not only cannot the automobile weight be reduced, but also the automobile's safety is jeopardized, thereby threatening the riders' lives.

In an attempt to solve the above problems, the present inventor disclosed the following inventions on the austenitic high manganese steel having superior formability and strengths. These are: Korean Patent Application No. 91-25112 (entitled "Austenitic High Manganese Steel Having Superior Formability and Strengths", filed on Dec. 12, 1991); Korean Patent Application No. 92-13309 (entitled "High Manganese Steel Having Superior Formability, Strengths And Weldability, And Manufacturing Method Therefor", filed on Jul. 24, 1992); and PCT Application No. PCT/KR 92/00082 (entitled "Austenitic High Manganese Steel Having Superior Formability, Strengths and Weldability, And Manufacturing Method Therefor", filed on Dec. 30, 1992).

The above mentioned high manganese steel having superior formability and strength is a steel of Fe—Mn—Al—C series, and contains large amounts of manganese and aluminum which are highly oxidable elements. Therefore, when it is annealed at a temperature of 500°–1000° C. under the usual atmosphere, a thick and dense oxide layer is formed on the surface of the steel sheet. If this thick and dense oxide layer is formed, it loses the commodity value as an automobile steel sheet and an electronic panel steel sheet. That is, during the manufacturing process of an automobile, if the thick and dense oxide layer is present, phosphating and painting become impossible, and therefore, it cannot be used for automobiles.

Further, if the thick and dense surface oxide layer is formed, it cannot be easily removed by pickling. Even if it is removed by using a strong chloric acid, the surface of the steel sheet becomes irregular, thereby lowering the commodity value. And also, hazard is latent in using the strong chloric acid, and a large scale pickling facility is required, thereby requiring a high facility cost.

SUMMARY OF THE INVENTION

In order to solve the problem of the formation of the thick and dense oxide layer during the manufacturing process of a high manganese steel, the present inventor carried out research and experiments, and came to propose the present invention based on the results of the research and experiments.

It is an object of the present invention to provide a method for annealing a cold rolled high manganese steel sheet. The annealing atmospheric gas is adjusted in annealing process so as to minimize the thickness of a surface oxide layer, and to make aluminum nitride into the oxide layer which is an agent for removing the oxide layer in the pickling process. The surface oxide layer can be easily removed, and thereby improving the peelability of the oxide layer.

It is another object of the present invention to provide a method for pickling a cold rolled high manganese steel sheet. The surface oxide layer distributed with aluminum nitrides is uniformly removed with a mild aqueous solution of chloric acid, thereby improving the surface quality of the steel sheet and saving the pickling facility cost.

The composition of the high manganese steel in the present invention contains in weight %: 1.5% or less of C, 15.0–35.0% of Mn, 0.1–6.0% of Al, balance of Fe and other incidental impurities. Also, one or two of the elements selected from a group consisting of: 0.6% or less of Si, 5.0% or less of Cu, 1.0% or less of Nb, 0.5% or less of V, 9.0% or less of Cr, 4.0% or less of Ni, and 0.2% or less of N is additionally added to the high manganese steel. This steel is cold-rolled, and annealed. The annealing atmosphere consists of 100% of nitrogen ($N_2$), or 50% or more of nitrogen and a balance of hydrogen ($H_2$). Thus the present invention provides an annealing method for a cold rolled high manganese steel sheet.

The cold rolled high manganic steel sheet is pickled for 30–90 seconds within an aqueous solution of chloric acid having an acid concentration of 0.06–0.8 weight % and a temperature of 15°–50° C., thereby removing the surface oxide layer. Thus the present invention provides a pickling method for a cold rolled high manganese steel sheet.

BRIEF DESCRIPTION OF THE DRAWINGS

The above object and other advantages of the present invention will become more apparent by describing in detail the preferred embodiment with reference to the attached drawing.

DETAILED DESCRIPTION OF THE PREFERRED EMBODIMENT

Figure 1:
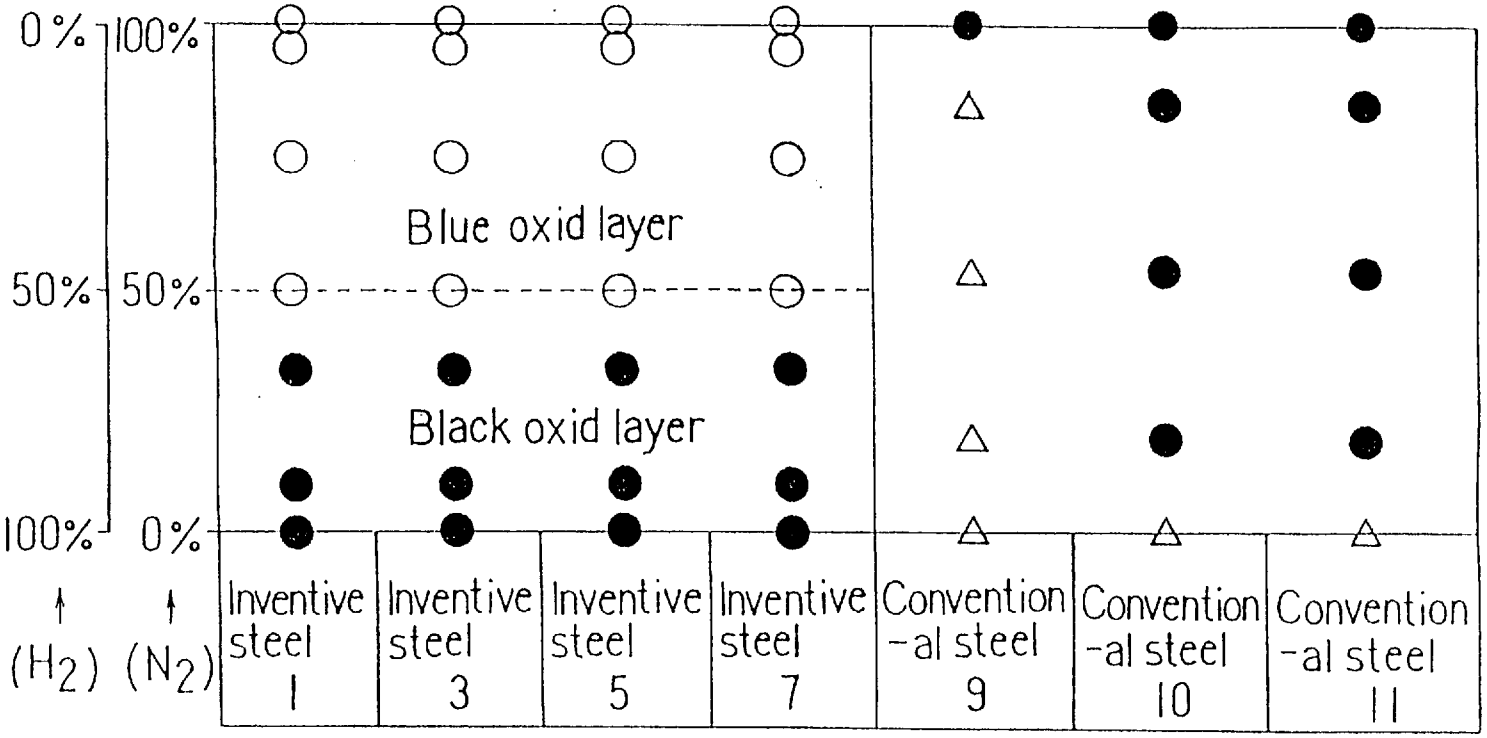
FIG. 1 is a graphical illustration showing the formation of the surface oxide layer versus the gas mixing ratio of the annealing atmosphere.

First, the annealing method will be described in which the surface oxide layer is minimized, and the peelability is improved in the pickling process.

In the case of the conventional extremely low carbon steel, an annealing is carried out under an atmosphere consisting of nitrogen gas plus 3–10% of hydrogen gas. The reason why such a small amount of hydrogen gas is used is that the high reducing property of hydrogen gas prevents the oxidation of steel (Fe). The conventional extremely low carbon steel contains the highly oxidable manganese and aluminum in the small amounts of 0.2% and 0.05%. Even if the low carbon steel is annealed under the above described annealing atmosphere, an aesthetically desirable steel sheet having no surface oxide layer can be obtained.

Meanwhile, in the electrical steel sheet containing the highly oxidable Si in such a large amount as 2–5%, or in the stainless steel containing the highly oxidable Cr in an amount of 13–25%, the annealing is carried out under an annealing atmosphere of 100% of hydrogen gas for preventing the surface oxide layer, thereby obtaining an aesthetically acceptable steel sheet having no surface oxide layer. If the electrical steel sheet or the stainless steel sheet containing large amounts of highly oxidable alloy elements is annealed under an atmosphere consisting of 3–10% of hydrogen and the balance of nitrogen (which is for the extremely low carbon steel), then a black surface oxide layer having a thickness of 10–100 μm will be formed.

Meanwhile, in the high manganese steel containing large amounts of Mn and Al which are more oxidable than Si and Cr, the formation of the surface oxide layer cannot be avoided with the conventional annealing method. Unlike the conventional extremely low carbon steel, the electrical steel sheet and the stainless steel sheet, large amounts of most highly oxidable Mn and Al are contained in the high manganese steel. And therefore, the formation behavior of the surface oxide layer of the high manganese steel becomes different. Even if annealed under an atmosphere of 100% of hydrogen, the high manganese steel containing Mn and Al shows the formation of a thick black oxide layer of 10–100 μm, thereby aggravating the surface quality. Therefore, with the conventional annealing method, the formation of the surface oxide layer cannot be avoided in the high manganese steel sheet.

In order to solve the problems encountered in annealing the high manganese cold rolled steel sheet, the present inventor carried out research and experiments, and based on the result, the present inventor came to propose the present invention.

In the present invention, the kind of the atmosphere and the mixing ratio within the annealing furnace are properly adjusted in annealing the high manganic cold rolled steel sheet, so that the thickness of the surface oxide layer of the steel sheet can be minimized to less than 1 μm. Further, in order to promote the peeling of the surface oxide layer during a pickling process, the water-soluble AlN precipitates are made to be dispersed within the surface oxide layer. A mild aqueous chloric acid solution intrude under the surface oxide layer through the AlN precipitates in the pickling process and the peelability of the surface oxide layer is improved.

Now the reason for selecting the annealing conditions and for limiting the ranges will be described.

The commercial nitrogen and hydrogen gases cannot be pure ones, but always contain small amounts of oxygen and moisture. Therefore, manganese and aluminum which are contained in the high manganese steel react with oxygen within the annealing furnace, thereby forming a thick oxide layer.

However, under an atmosphere in which nitrogen is contained by 50% or more, only a blue oxide layer is formed by 1 μm or less, and no further oxidation occurs. The reason is as follows. During the initial stage of the annealing, oxygen forms oxides such as $MnAl_2O_4$ and $MnO.Al_2O_3$ having the spinelic structure on the surface of the high manganese steel sheet, and these oxides serve as catalysts to remove all the remaining oxygen in annealing atmospheric gas.

That is, the oxides such as $MnAl_2O_4$ and $MnO.Al_2O_3$ serve as the catalysts for the following chemical reaction.

$$N_2+O_2 \rightarrow 2NO_2$$

Therefore, no further oxygen remains in the atmospheric gas, and the oxidation of the high manganese steel sheet proceeds no more.

However, when the nitrogen content within the atmospheric gas becomes less than 50%, the above chemical reactions are delayed, and therefore, oxygen remains within the atmospheric gas, with the result that a thick black oxide layer of over 10 μm is formed. Therefore, if the thickness of the oxide layer is to be minimized, the nitrogen content within the atmospheric gas should be maintained at 50% or more.

Meanwhile, during the initial stage of the annealing, $N_2$ of the atmospheric gas reacts with Al of the surface of the steel sheet so as to form a nitride (AlN). This nitride is dispersedly distributed within the surface oxide layer in a uniform manner. The AlN precipitates which are uniformly distributed within the thin surface oxide layer serve as passages for introducing the chloric acid solution into under the bottom of the oxide layer during a pickling process which is carried out after the annealing process. Thus the peeling of the oxide layer is promoted.

However, if the nitrogen content within the atmospheric gas is less than 50%, the formation of the nitride (AlN) becomes insufficient and the nitride cannot be uniformly distributed in surface oxide layer. Therefore, the peeling of the oxide layer during the pickling becomes non-uniform, thereby degrading the surface quality of the steel sheet. Further, if the nitrogen content is less than 50%, the surface oxide layer becomes as thick as 10 μm, with the result that the nitride (AlN) is tightly surrounded by the oxide layer. Therefore, the nitride cannot directly contact with the chloric acid solution and the nitride cannot serve as passages for introducing the chloric acid solution into under the surface oxide layer. As the result the peelability of the oxide layer cannot be improved.

In order that the surface oxide layer is to be minimized to less than 1 μm and the nitride (AlN) is to be uniformly distributed for improving the peelability of the surface oxide layer, the nitrogen content of the atmospheric gas of the annealing furnace should be 50% or more.

Now the pickling method for removing the surface oxide layer from the annealed high manganese steel sheet by using an aqueous chloric solution will be described.

If the surface oxide layer formed in the annealing process is not removed, it becomes impossible to carry out phosphating and painting on the surface of the steel sheet during the manufacture of automobiles and electronic panels. Even if the surface oxide layer is removed, if the surface of the steel sheet becomes irregular due to the short-pickling or over-pickling, then the aesthetic acceptability cannot be ensured after carrying out the phosphating and painting.

In order to solve the problems of short-pickling and over-pickling during the removal of the surface oxide layer after annealing the high manganese cold rolled steel sheet, the present inventor carried out research and experiments. Based on the results, the present inventor came to propose the present invention. In the present invention, the concentration and temperature of the chloric acid solution and the pickling time period are properly adjusted, so that the surface oxide layer of the steel sheet can be uniformly and completely removed.

The general chemical reaction formulas for removing the surface oxide layer by using chloric acid are as follows.

$$FeO+2HCl \rightarrow FeCl_2+H_2O \quad (1)$$

$$MnO+2HCl \rightarrow MnCl_2+H_2O \quad (2)$$

$$Al_2O_3+6HCl \rightarrow 2Al_2O_3+3H_2O \quad (3)$$

The above three kinds of chemical reactions are different from one another in their reaction rates. The reaction rate of reaction (1) is higher than those of reactions (2) and (3). The surface oxide layer surrounded with FeO is pickled faster than the area surrounded with MnO and $Al_2O_3$. Therefore, the base metal is corroded in the portion where the reaction (1) occurs, while the portions where the reactions (2) and (3) occur are non-pickled. After the pickling, the surface of the steel sheet would become irregular.

If the AlN precipitates are uniformly distributed within the surface oxide layer after the annealing, the occurrence of the irregularity after the pickling is prevented. The AlN precipitates which are uniformly distributed in the form of dots within the surface oxide layer are first corroded by chloric acid. Then through the many dots where AlN precipitates were corroded, chloric acid intrudes into under the surface oxide layer, thereby making the oxide layer peeled off easily. Therefore, a product of superior surface quality is obtained without being accompanied by a short-pickling or an over-pickling.

Now the reason for limiting the pickling conditions for the high manganese cold rolled steel sheet will be described.

During the pickling of the surface oxide layer in the present invention, the concentration of chloric acid should be preferably limited to 0.06–0.8 weight %. If the concentration of chloric acid exceeds 0.8%, the AlN portion which serves as passages for introducing chloric acid into under the oxide layer is over-pickled, thereby forming pittings. On the other hand, if the concentration of chloric acid is less than 0.06%, the intrusion of chloric acid into under the oxide layer is delayed, with the result that it takes too much time to peel the oxide layer.

In the present invention, the temperature of the aqueous chloric acid solution should be preferably 15°–50° C. The reason is as follows. That is, if the temperature of chloric acid is below 15° C., the intrusion of the chloric acid solution into under the oxide layer is delayed, with the result that no acceptable peeling of the oxide layer can be obtained. If it exceeds 50° C., reactions with the base metal are promoted. As a result, not only an over-pickling occurs, but also the aqueous chloric acid solution is evaporated very much, thereby jeopardizing human health.

Meanwhile, the pickling time should be preferably 30–90 seconds. The reason is as follows. That is, if the pickling time is less than 30 seconds, the time for corroding the AlN precipitates by the aqueous chloric acid solution and the time for intruding into under the oxide layer by the aqueous chloric acid solution becomes insufficient. Therefore, the peeling of the oxide layer cannot be achieved. On the other hand, if the pickling time exceeds 90 seconds, an over-pickling occurs.

EXAMPLE 1

High manganese steels composed of as shown in Table 1 below were vacuum-melted, and ingots of 50 Kg were formed in a thickness of 160 mm. Then they were hot-rolled into a thickness of 2.5 mm, and then, they were cold-rolled into a thickness of 0.7 mm. Then the cold rolled steel sheets were annealed at a temperature of 800° C. for 1.5 minutes under atmospheric gases which are shown in Table 2 below. Under this condition, the dew point of the annealing atmosphere was −18° C. as usually practiced in commercial annealing line, thereby inhibiting the moisture content within the atmospheric gas.

Then for the annealed steel sheets, the color of the surface oxide layer was checked by human eyes, and the thicknesses of the surface oxide layers were measured by using an electron microscope (SEM, Auger). The test results are shown in Table 2 below, and the results of the comparative tests of the inventive steels and the conventional steels are illustrated in FIG. 1. The color of the annealed steel sheet is the parameter for the thickness of the oxide layer. That is, black color indicates 10–100 μm, and transparent blue color indicates 0.1–1 μm. Therefore, the surface color of the steel sheet was observed by human eyes.

TABLE 1

(wt %)

| Steel No. | C | Mn | Al | Si | Cr | Ni | Cu | Nb | V | Ti | N |
|---|---|---|---|---|---|---|---|---|---|---|---|
| Inventive steel | | | | | | | | | | | |
| 1 | 0.75 | 15.7 | 3.2 | — | — | — | — | — | — | — | 0.017 |
| 2 | 0.08 | 24.8 | 1.2 | — | — | — | — | — | — | — | 0.024 |
| 3 | 0.14 | 25.1 | 0.3 | — | — | — | — | — | — | — | 0.015 |
| 4 | 0.36 | 23.7 | 1.7 | — | — | — | — | 0.2 | — | 0.08 | 0.019 |
| 5 | 0.09 | 24.6 | 5.5 | — | — | — | — | — | 0.3 | 0.14 | 0.029 |
| 6 | 1.20 | 27.6 | 1.4 | 0.13 | — | — | — | — | — | 0.15 | 0.018 |
| 7 | 0.38 | 28.5 | 3.3 | — | 1.3 | 1.7 | — | 0.1 | — | — | 0.017 |
| 8 | 0.28 | 33.5 | 2.1 | — | — | — | 0.5 | 0.1 | — | — | 0.016 |
| Conventional steel | | | | | | | | | | | |
| 9 | 0.002C—0.5Mn—0.035Al—0.018P—0.025Ti—0.015Nb—0.0030N | | | | | | | | | | |
| 10 | 0.003C—3.2Si—0.03Mn—0.008Al (electrical steel sheet) | | | | | | | | | | |
| 11 | 0.06C—0.32Si—1.21Mn—18.5Cr—8.2Ni (Stainless steel) | | | | | | | | | | |

| Atmospheric gases | Air | 100% $H_2$ | 60% $H_2$+ 40% $N_2$ | 40% $H_2$+ 60% $N_2$ | 20% $H_2$+ 80% $N_2$ | 100% $N_2$ |
|---|---|---|---|---|---|---|
| Color of surface oxide layer of steel sheet | Black | Black | Black + Blue | Blue | Blue | Blue |
| Thickness of surface oxide layer of steel sheet (μm) | 90 | 57 | 15 | 1.0 | 0.9 | 0.2 |

As shown in Table 2 above, under the atmosphere consisting of 50% or more of nitrogen and a balance of hydrogen, or under the atmosphere consisting of 100% of nitrogen, the annealed steel sheets showed blue color. It meant that the thickness of the oxide layer of the steel sheets was 1 μm or less. This proves the fact that $MnAl_2O_4$ or $MnO.Al_2O_3$ having the spinel structure was formed during the initial annealing stage, so that the oxygen contained within the atmospheric gases was reacted with nitrogen, thereby preventing further oxidation of the surface of the high manganese steel sheets. Meanwhile, the steel sheets, which were annealed within atmospheric gases consisting of less than 50% of nitrogen plus a balance of hydrogen, or 100% of hydrogen, or which were annealed in the air, showed black surface color. The measured thickness of the oxide layer of the steel sheets was more than 15 μm.

Meanwhile, as shown in FIG. 1, the steel sheets which were annealed within atmospheric gases consisting of 50% or more of nitrogen plus a balance of hydrogen, or 100% of nitrogen showed blue surface color, thereby proving the fact that the annealing conditions of the present invention were proper.

EXAMPLE 2

The inventive steel 5 was annealed at a temperature of 800° C. for 1.5 minutes under an atmosphere consisting of 100% of $N_2$, and then, picklings were carried out by varying the pickling time to 20–100 seconds, the chloric acid concentration to 0.05–9%, and the solution temperature to 10°–60° C. The results are shown in Table 3 below.

TABLE 3

| | Pickling conditions for removing oxide layer | | | Evaluation |
|---|---|---|---|---|
| | HCl concentration (wt. %) | Solution Temperature (°C.) | Pickling time (Sec.) | (for peeling of oxide layer) |
| Inventive example | | | | |
| a | 0.06 | 50 | 90 | ○ |
| b | 0.06 | 25 | 60 | ○ |
| c | 0.1 | 40 | 50 | ○ |
| d | 0.3 | 15 | 70 | ○ |
| e | 0.5 | 30 | 30 | ○ |
| f | 0.8 | 15 | 40 | ○ |
| Comparative example | | | | |
| 1 | 0.05 | 45 | 90 | x |
| 2 | 0.05 | 50 | 90 | x |
| 3 | 0.85 | 40 | 50 | Δ |
| 4 | 0.90 | 15 | 40 | Δ |
| 5 | 0.1 | 10 | 30 | x |
| 6 | 0.6 | 60 | 30 | Δ |
| 7 | 0.7 | 15 | 20 | x |
| 8 | 0.8 | 15 | 100 | Δ |

○ : absence of oxide layer after pickling.
x: presence of oxide layer after pickling (short-pickling).
Δ: formation of pittings after pickling (over-pickling).

As can be seen in Table 3 above, the inventive examples (a)–(f) were annealed by meeting the required conditions, and therefore, a presence of an oxide layer on the surfaces of the steel sheets, i.e., a short-pickling did not occur, nor did an over-pickling such as pitting occur. Thus an aesthetically desirable steel surfaces were obtained.

Meanwhile, in the comparative examples (1) and (2), the concentration of the aqueous chloric acid solution was too low. Therefore, in spite of the fact that the temperature of the solution and the pickling time were proper, a presence of an oxide layer, i.e., a short-pickling occurred even after carrying out the pickling.

In the comparative examples (3) and (4), the concentration of the aqueous chloric acid solution was too high compared with that of the inventive examples. Therefore, in spite of the fact that the temperature of the solution and the pickling time were proper, an over-pickling in the form of pittings occurred after carrying out the pickling.

In the comparative examples (5) and (6), the concentration of the aqueous chloric acid solution and the pickling time belonged to the ranges of those of the inventive examples. However, the temperature of the solution departed from the range of that of the inventive examples, and therefore, short-picklings and over-picklings occurred.

In the comparative examples (7) and (8), the concentration of the aqueous chloric acid solution and the temperature of the solution were proper, but the pickling time was not proper. Therefore, short-picklings and over-picklings occurred.

According to the present invention as described above, the annealing conditions are properly adjusted during the annealing of the high manganese cold rolled steel sheets, so that a surface oxide layer containing AlN would be formed by 1 μm or less. Thus the pickling efficiency can be improved during the pickling. Further during the pickling, the pickling conditions such as concentration of the aqueous chloric acid solution, the temperature of the solution and the pickling time are properly adjusted, so that the surfaces of the cold rolled high manganese steel sheets would be aesthetically desirable.

What is claimed is:

1. A method for annealing a cold rolled high manganese steel sheet composed of in weight %:1.5% or less of C, 15.0–35.0% of Mn, 0.1–6.0% of Al, balance of Fe and incidental impurities, an ingot of the steel is hot-rolled to form a steel sheet and said steel sheet is then cold-rolled, characterized in that the resulting cold rolled steel sheet is annealed in an atmosphere consisting of 100% of nitrogen, or 50% or more of nitrogen plus the balance of hydrogen.

2. The method as claimed in claim 1, wherein said cold rolled steel sheet is annealed in such a manner that a surface oxide layer containing AlN having a thickness of 1 μm or less is formed.

3. A method for annealing a cold rolled high manganese steel sheet composed of in weight %:1.5% or less of C, 15.0–35.0% of Mn, 0.1–6.0% of Al, balance of Fe and incidental impurities, additionally adding one or two elements selected from a group consisting of: 0.6% or less of Si, 5.0% or less of Cu, 1.0% or less of Nb, 0.5% or less of V, 9.0% or less of Cr, 4.0% or less of Ni, and 0.2% or less of N, an ingot of the steel is hot-rolled to form a steel sheet and said steel sheet is then cold-rolled, characterized in that the resulting cold rolled steel sheet is annealed in an atmosphere consisting of 100% of nitrogen, or 50% or more of nitrogen plus the balance of hydrogen.

4. The method as claimed in claim 3, wherein said cold rolled steel sheet is annealed in such a manner that a surface oxide layer containing AlN having a thickness 1 μm or less is formed.

5. A method for pickling a cold rolled high manganese steel sheet composed of in weight %: 1.5% or less of C, 15.0–35.0% of Mn, 0.1–6.0% of Al, balance of Fe and incidental impurities, an ingot of the steel is hot-rolled to form a steel sheet and said steel sheet is then cold-rolled, and the resulting cold rolled steel sheet is annealed in an atmosphere consisting of 100% of nitrogen, or 50% or more of nitrogen plus the balance of hydrogen, in such a manner that a surface oxide layer containing AlN and having a thickness of 1 $\mu$m or less is formed, the method characterized in that the resulting annealed steel sheet is pickled for 30–90 seconds in an aqueous chloric acid solution having a chloric acid concentration of 0.06–0.8 weight % and having a solution temperature of 15°–50° C., whereby the surface oxide layer of said steel sheet is removed.

6. A method for pickling a cold rolled high manganese steel sheet composed of in weight %: 1.5% or less of C, 15.0–35.0% of Mn, 0.1–6.0% of Al, balance of Fe and incidental impurities, additionally adding one or two elements selected from a group consisting of: 0.6% or less of Si, 5.0% or less of Cu, 1.0% or less of Nb, 0.5% or less of V, 9.0% or less of Cr, 4.0% or less of Ni, and 0.2% or less of N, an ingot of the steel being hot-rolled to form a steel sheet and said steel sheet is then cold-rolled, and said steel sheet being annealed under an 30 atmosphere consisting of 100% of nitrogen, or 50% or more of nitrogen plus the balance of hydrogen, in such a manner that a surface oxide layer containing AlN having a thickness of 1 $\mu$m or less is formed, the method characterized in that the resulting steel sheet is pickled for 30–90 seconds in an aqueous chloric acid solution having a chloric acid concentration of 0.06–0.8 weight % and having a solution temperature of 15°–50° C., whereby the surface oxide layer of said steel sheet is removed.

* * * * *

UNITED STATES PATENT AND TRADEMARK OFFICE

CERTIFICATE OF CORRECTION

PATENT NO. : 5,810,950
DATED : September 22, 1998
INVENTOR(S) : Tai Woung Kim et al.

It is certified that error appears in the above-identified patent and that said Letters Patent is hereby corrected as shown below:

Column 3 Line 43 "intrude" should read --intrudes--.

Column 6 Line 55 above second Table insert --Table 2--.

Column 7 Line 29 "0.05-9%" should read --0.05-0.9%--.

Column 7 Line 64 after "Thus" delete --an--.

Claim 4 Column 8 Line 62 after "thickness" insert --of--.

Claim 6 Column 10 Line 6 before "atmosphere" delete --30--.

Signed and Sealed this

Tenth Day of August, 1999

*Attest:*

Q. TODD DICKINSON

*Attesting Officer*

*Acting Commissioner of Patents and Trademarks*